US006334738B1

(12) United States Patent
Juracko

(10) Patent No.: US 6,334,738 B1
(45) **Date of Patent: *Jan. 1, 2002**

(54) PREFABRICATED METAL OVERCAST HAVING A CRUSHABLE LOWER SECTION

(75) Inventor: Rudolph J. Juracko, Mt. Morris, PA (US)

(73) Assignee: RAG American Coal Company, Linthicum Heights, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/618,989

(22) Filed: Jul. 18, 2000

Related U.S. Application Data

(63) Continuation of application No. 09/237,341, filed on Jan. 26, 1999, now Pat. No. 6,129,483.

(51) Int. Cl.[7] ..... E02D 29/00; E02D 3/02; E21D 9/00

(52) U.S. Cl. ..... 405/132; 405/151; 405/288; 405/290; 454/169

(58) Field of Search ..... 405/124, 125, 405/132, 151, 288, 290, 291; 248/351, 354.2; 52/724.1–5, 262; 454/169, 170, 171

(56) References Cited

U.S. PATENT DOCUMENTS

| | | | | |
|---|---|---|---|---|
| 987,397 A | | 3/1911 | Pittroff | |
| 1,664,646 A | | 4/1928 | Sweet | |
| 2,729,066 A | | 1/1956 | Kennedy et al. | |
| 3,444,962 A | * | 5/1969 | Lech | |
| 3,659,814 A | | 5/1972 | Rode | 248/23 |
| 3,998,062 A | | 12/1976 | Lange | 61/50 |
| 4,052,029 A | | 10/1977 | Townsend | 248/356 |
| 4,143,991 A | | 3/1979 | Stafford | 405/291 |
| 4,221,413 A | * | 9/1980 | Bonnetain | 293/122 |
| 4,255,071 A | | 3/1981 | Koppers et al. | 405/290 |
| 4,274,764 A | | 6/1981 | Curry | 405/291 |
| 4,318,635 A | | 3/1982 | Gurtner et al. | 405/126 |
| 4,459,064 A | | 7/1984 | Berset | 405/138 |
| 4,531,619 A | * | 7/1985 | Eckels | 188/371 |
| 4,593,870 A | * | 6/1986 | Cronkhite et al. | 244/117 R |
| 4,621,951 A | | 11/1986 | Dewson | 405/303 |
| 4,915,540 A | | 4/1990 | Kennedy et al. | 405/132 |
| 4,997,317 A | | 3/1991 | Schonfeld et al. | 405/288 |
| 5,174,682 A | | 12/1992 | Whitfield | 405/132 |
| 5,308,196 A | | 5/1994 | Frederick | 405/288 |
| 5,412,916 A | | 5/1995 | Kennedy et al. | 52/262 |
| 5,879,231 A | | 3/1999 | Sisk | 454/169 |
| 6,129,483 A | * | 10/2000 | Juracko | 405/132 |

FOREIGN PATENT DOCUMENTS

| | | | |
|---|---|---|---|
| DE | 19724492 A1 | * | 12/1998 |
| GB | 1436701 | * | 5/1976 |

* cited by examiner

*Primary Examiner*—David Bagnell
*Assistant Examiner*—Jong-Suk Lee
(74) *Attorney, Agent, or Firm*—Bruce E. Dahl, Esq.; Dahl & Osterloth, L.L.P.

(57) ABSTRACT

A ventilation overcast comprises a frame member that defines a structure having a substantially inverted U-shape with first and second opposed side wall portions and a roof portion. A curtain member having a plurality of longitudinal corrugations therein is positioned adjacent the frame member so that a bottom portion of the curtain member contacts the floor of the mine. The longitudinal corrugations allow the curtain member to be crushed when subjected to floor heave.

5 Claims, 4 Drawing Sheets

PREFABRICATED METAL OVERCAST HAVING A CRUSHABLE LOWER SECTION

This application is a continuation of U.S. patent application Ser. No. 09/237,341, filed Jan. 26, 1999, U.S. Pat. No. 6,129,483, which is incorporated herein by reference for all that it discloses.

FIELD OF THE INVENTION

The present invention relates to mine ventilation overcasts in general and more specifically to prefabricated metal overcasts capable of compensating for floor heave.

BACKGROUND

Ventilation overcasts are commonly installed at various places in the entries (i.e., tunnels) in underground mines, such as coal mines, and are used to separate the intake and return air flows used to ventilate the mines. In general, such ventilation overcasts take the form of substantially air-tight bridges which permit the crossing of intake and return airways without interference.

Many different types of ventilation overcasts have been developed over the years and have been used with varying degrees of success. For example, ventilation overcasts have been constructed of tile, brick, stone, concrete, concrete blocks, steel panels, or combinations of the foregoing materials, with steel beams being used where necessary to provide additional support. Ventilation overcasts made from the foregoing materials typically require 2–6 days to construct, depending on the particular design and materials used. For example, overcasts fabricated from bricks or concrete blocks generally require 4–6 days to construct, while other designs utilizing primarily steel members may be constructed in less time, typically about 2–3 days.

The construction of such ventilation overcasts represents a substantial portion of the time, thus cost, required to develop and maintain the underground mine ventilation system. Consequently, devices and methods are always being sought which can reduce the time and/or cost required to acquire, set-up, and maintain the ventilation overcast. Toward this end, several different types of "quick assembly" ventilation overcasts have been developed in recent years which further reduce the time required for construction. While such "quick assembly" overcasts are being used more and more frequently, many still require at least one day (i.e., one work shift) to install.

One problem that may complicate the design and construction of ventilation overcasts is the degree of floor heave that may be expected in the mine. While some mines experience more floor heave than others, all mines experience at least some degree of floor heave. Heaving of the mine floor can compromise the air-tight construction of the overcast, causing intermixing of the return and intake air flows. Such intermixing of the return and intake air flows may violate applicable ventilation regulations and, in any event, represents an undesirable circumstance. Moreover, if the floor heave is excessive, it can result in structural damage to the overcast, possibly requiring that the overcast be repaired or even replaced before mining can continue.

Primarily in an effort to address the foregoing problems, ventilation overcasts have been developed which can compensate for a certain amount of floor heave. Unfortunately, the structure required to accommodate such floor heave tends to further increase the complexity, thus cost of the ventilation overcast. Furthermore, such accommodations usually require additional time to construct, thereby removing some of the advantages associated with quick assembly type of ventilation overcasts in which they may be utilized.

SUMMARY OF THE INVENTION

A ventilation overcast may comprise a frame member that defines a structure having a substantially inverted U-shape with first and second opposed side wall portions and a roof portion. A curtain member having a plurality of longitudinal corrugations therein is positioned adjacent the frame member so that a bottom portion of the curtain member contacts the floor of the mine.

BRIEF DESCRIPTION OF THE DRAWING

Illustrative and presently preferred embodiments of the invention are shown in the accompanying drawing in which.

DETAILED DESCRIPTION OF THE INVENTION

Figure 1:
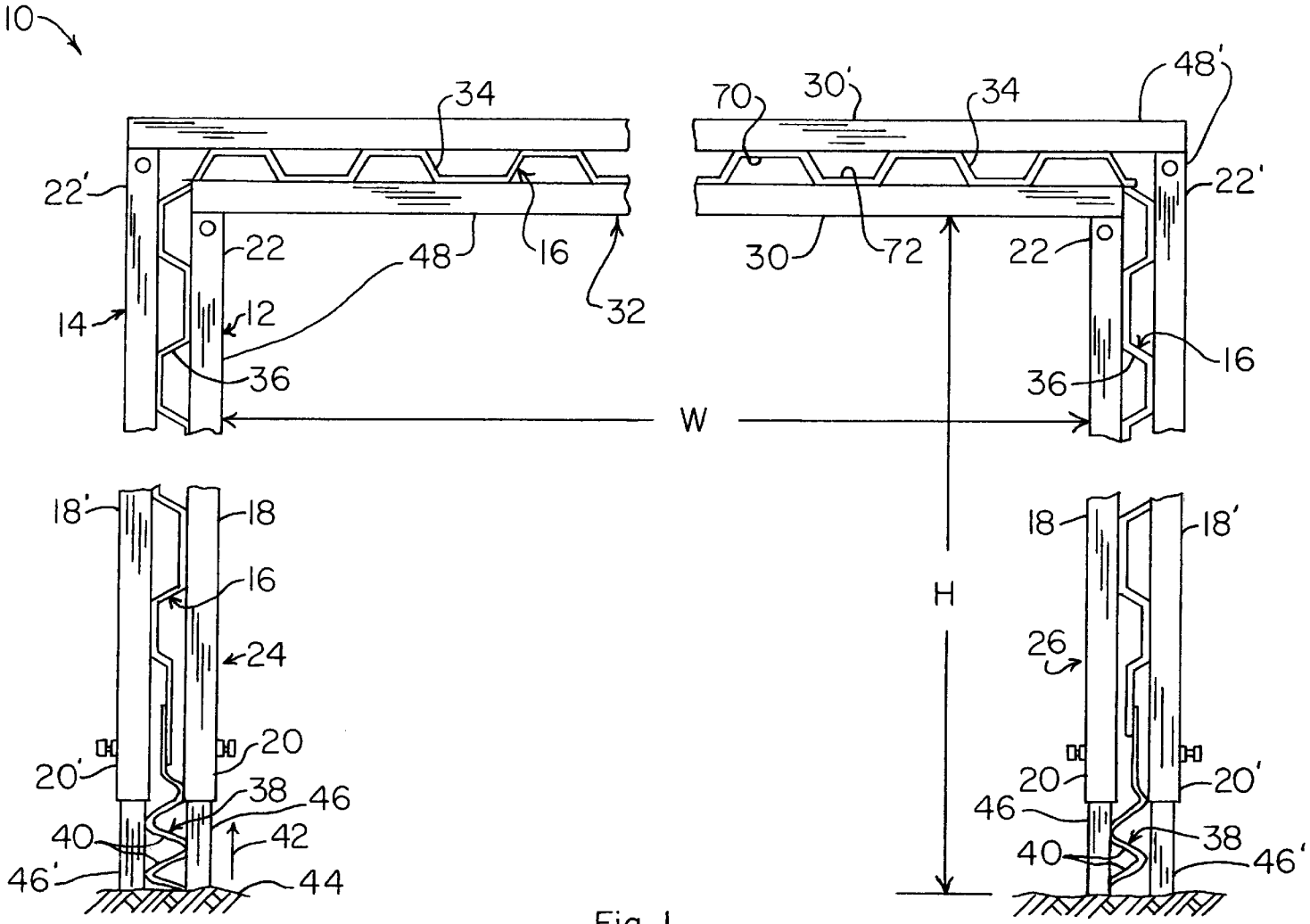
FIG. 1 is a front view in elevation of one embodiment of a ventilation overcast according to the present invention showing the arrangement of the inner and outer frame members and the panel members positioned therebetween.
Figure 2:
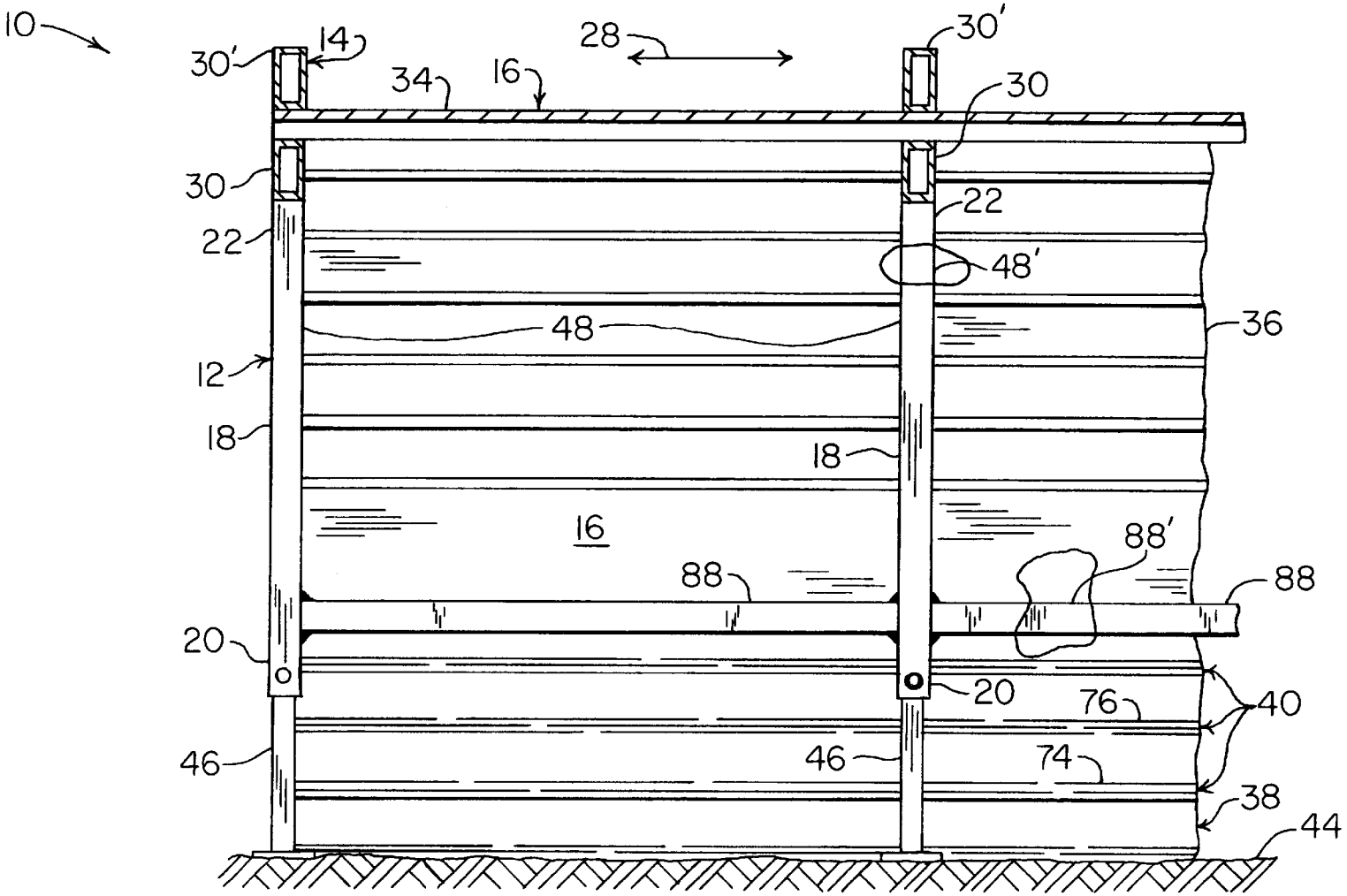
FIG. 2 is a side view in elevation of a portion of the inside side wall portion of the ventilation overcast showing the arrangement and spacing of the vertical support columns and the horizontal cross beams.

A ventilation overcast 10 according to one preferred embodiment of the present invention is best seen in FIGS. 1 and 2 and may comprise an inner frame assembly 12 and an outer frame assembly 14 between which are positioned a plurality of panel members 16. The inner frame assembly 12 may comprise a plurality of inner vertical support columns 18, each of which includes a lower end 20 and an upper end 22, as well as a plurality of horizontal cross beams 30. The inner vertical support columns 18 may be positioned in generally opposed relation on opposite sides of the mine entry (not shown) so that they define respective first and second side wall portions 24 and 26 of the ventilation overcast 10. Each side wall portion 24, 26 of the overcast 10 may be made as long as necessary by providing additional inner vertical support columns 18 at spaced positions along the lengthwise or longitudinal direction 28 of the ventilation overcast 10. See FIG. 2. The upper ends 22 of each pair of opposed inner vertical support columns 18 (i.e., those inner columns 18 located opposite one another on respective side wall portions 24 and 26) may be joined together by a horizontal cross beam 30, as best seen in FIG. 1. The cross beams 30 define a roof portion 32 of the ventilation overcast 10. In accordance with the foregoing structural arrangement, the inner frame assembly 12 defines a structure having a generally inverted "U" shape or configuration.

The outer frame assembly 14 is similar to the inner frame assembly 12 just described and may comprise a plurality of outer vertical support columns 18' and outer horizontal cross beams 30'. Each outer vertical support column 18' may comprise a lower end 20' and an upper end 22'. The outer vertical support columns 18' may be positioned in pairs in generally opposed spaced relation on opposite sides of the mine entry, so that each outer vertical support column 18' is generally outboard of a corresponding inner vertical support column 18, as best seen in FIG. 1. Several such outer vertical support columns 18' may be spaced along the length 28 of the ventilation overcast 10 as necessary to provide each side wall portion 24, 26 of the overcast 10 with the desired length. See, generally FIG. 2. The upper ends 22' of opposed outer vertical support columns may be connected together by respective outer horizontal cross beams 30'. The outer frame assembly 14 therefore defines a generally inverted "U" shaped structure that is generally exterior to the inner frame assembly 12. Stated another way, the inner frame assembly 12 is "nested" within the outer frame assembly 14. See FIG. 1.

The spaces defined between the inner and outer frame assemblies 12 and 14 may be closed by a plurality of panel members 16. Accordingly, the panel members 16, together with the inner and outer frame assemblies 12 and 14, define a substantially air-tight structure having a generally inverted "U" shape that comprises the ventilation overcast 10. In the embodiment shown and described herein, the plurality of panel members 16 may comprise one or more top panels 34 that are sized to be received between the inner and outer horizontal cross beams 30 and 30', as well as one or more side panel members 36 sized to be received between the inner and outer vertical support columns 18 and 18'. Curtain members 38 may be positioned between the lower ends 20 and 20' of the inner and outer vertical support columns 18 and 18', as best seen in FIG. 1. Each curtain member 38 may be provided with a plurality of longitudinal corrugations 40 that extend along the length 28 (FIG. 2) of the overcast 10. The longitudinal corrugations 40 allow the curtain members 38 to be displaced upward (i.e., crushed) in the direction indicated by arrow 42 in order to accommodate upheaval of the mine floor 44. The lower ends 20, 20' of the vertical support columns 18, 18' may be provided with respective retractable inner and outer foot members 46, 46' which yield upwardly (i.e., also in the direction of arrow 42) when subjected to floor heave.

The ventilation overcast 10 may be installed by first positioning the outer vertical support columns 18' on opposite sides of the mine entry (not shown), preferably with their respective foot members 46' fully retracted into the outer vertical support columns 18'. The inner vertical support columns 18 may then be placed adjacent the outer vertical support columns 18', again, preferably with their respective foot members 46 fully retracted. Next, the inner horizontal cross beams 30 may be attached to the upper ends 22 of the various inner vertical support columns 18. After all the inner horizontal cross beams 30 have been secured in position, the user may then slide the top panels 34 over the tops of the inner horizontal cross beams 30 so that the top panels 34 are supported thereby. At this point, the various side panels 36 also may be moved into position between the inner and outer vertical support columns 18, 18'. Similarly, the curtain members 38 may be positioned between the lower ends 20, 20' of the inner and outer vertical support columns 18, 18' and the inner and outer foot members 46, 46'. After the panels 34, 36 and curtains 38 have been properly positioned adjacent the inner frame assembly 12, the outer horizontal cross beams 30' may be secured between the outer vertical support columns 18' to form the structure substantially as shown in FIG. 1. Suitable jacking apparatus, such as one or more roof jacks (not shown) then may be used to raise the roof portion 32 of the ventilation overcast 10 to the appropriate height. Thereafter, the inner and outer retractable foot members 46 and 46' may be lowered so that they contact the mine floor 44. Any subsequent floor heave will be accommodated by the crushable corrugated curtain members 38 and retractable foot members 46, 46', thereby allowing a substantially air-tight seal to be maintained between the ventilation overcast 10 and the mine entry.

A significant advantage associated with the ventilation overcast 10 according to the present invention is that the various structural components (e.g., the vertical support columns 18, 18'; the horizontal cross beams 30, 30' and the various panels 16) may be prefabricated outside the mine, thereby allowing the ventilation overcast 10 to be quickly constructed once the various components have been delivered to the appropriate location within the mine itself. The structural design of the overcast 10 also limits the number of fasteners required for assembly which again speeds construction. For example, the inner and outer frame assemblies 12 and 14 securely hold in place the various panels 16, thereby substantially reducing, or in some cases even eliminating, the need to use separate fasteners (e.g., bolt and nut assemblies) to secure the various panels to the frame members. The inner and outer frame assemblies 12 and 14 also simplify construction by allowing the various panel members 16 to be placed on the inner frame assembly 12 before the outer horizontal cross beams 30' are secured into position. That is, the inner frame assembly 12 supports the various top panels 34 while construction is being completed on the outer frame assembly 14.

Still other advantages are associated with the curtain members 38 and retractable foot members 46, 46'. For example, the curtain members 38 and retractable inner and outer foot members 46 and 46' allow the seal between the overcast 10 and the mine floor 44 to remain substantially intact even if the floor heaves. The curtain members 38 and yielding foot members 46, 46' also substantially reduce the likelihood that the overcast will be structurally damaged if the floor heaves.

Having briefly described the ventilation overcast 10, as well as some of its more significant features and advantages, the various embodiments of the ventilation overcast according to the present invention will now be described in detail. However, before proceeding with the description, it should be noted that while the ventilation overcast 10 shown and described herein is specifically designed to be used in a coal mine with a particular type of entry system having specific configurations, it is not limited to use in any type of mine having any particular type of entry system. Consequently, the present invention should not be regarded as limited to the applications and dimensional configurations shown and described herein.

With the foregoing considerations in mind, one embodiment of a ventilation overcast 10 according to the present invention is best seen in FIGS. 1 and 2 and may comprise a generally inverted "U" shaped structure formed by an inner frame assembly 12 and an outer frame assembly 14 with a plurality of panel members 16 sandwiched therebetween. The inner frame assembly 12 may comprise a plurality of inner frame members 48 positioned in spaced-apart relation along the length 28 of the ventilation overcast 10. See FIG. 2. Similarly, the outer frame assembly 14 may comprise a plurality of outer frame members 48' positioned in spaced-apart relation along the length 28 of the ventilation overcast 10. In one preferred embodiment, the outer frame members 48' are positioned so that they are substantially aligned with the inner frame members 48, although this need not be the case. The inner and outer frame members 48, 48' comprising the respective inner and outer frame assemblies 12 and 14 will now be described in detail.

Referring now primarily to FIGS. 1 and 2, each inner frame member 48 is essentially identical and may comprise a pair of inner vertical support columns 18, each of which has a lower end 20 and an upper end 22. The pair of inner vertical support columns 18 are positioned in opposed, spaced-apart relation, i.e., on opposite side wall portions 24 and 26 of overcast 10, as best seen in FIG. 1. The respective upper ends 22 of the inner vertical support columns 18 are joined together by a horizontal cross beam member 30, as is also best seen in FIG. 1.

The inner horizontal cross beam 30 may be joined to the upper end 22 of the vertical support column 18 according to any of a wide variety of structural arrangements and using any of a wide range of fasteners that are well-known in the art. By way of example, in one preferred embodiment, each end (e.g., 50) of the horizontal cross beam 30 may be provided with a connecting lug 52 designed to be received by the open upper end 22 of the inner vertical support column 18. See FIG. 3. The connecting lug 52 may be provided with a hole 54 therein positioned so that it aligns with a mating hole 56 provided in the upper end 22 of the vertical support column 18. A pin or bolt and nut assembly (not shown) may be inserted through the aligning holes 54 and 56 to secure the horizontal cross beam 30 to the upper end 22 of the vertical support column 18. Alternatively, other types of arrangements now known in the art or that may be developed in the future may be utilized to secure the horizontal cross beam 30 to the vertical support column 18.

With reference now primarily to FIG. 2, it is preferred, but not required, that adjacent inner vertical support columns be connected together by means of longitudinal stringers 88. The stringers 88 provide increased structural support for the various frame members 48 which is advantageous, particularly if the top and side panels 34 and 36 are not separately fastened to the various frame members 48. The various stringers 88 may be fastened to the inner vertical support columns 18 by any of a wide range of fastening systems or devices well-known in the art. By way of example, in one preferred embodiment, the stringers 88 are welded to the vertical support columns 18.

Figure 4:
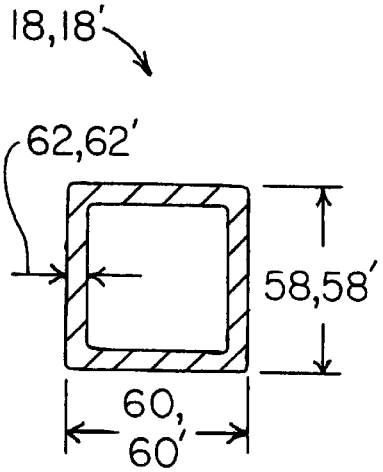
FIG. 4 is a cross-section view in elevation of a vertical support column.

Referring now to FIG. 4, each vertical support column 18 may comprise an elongate member having a rectangular or square cross-section with a height 58 of about 2 inches, a width 60 of about 2 inches, and a wall thickness 62 of about ⅛ inch. Alternatively, the support column 18 may have other dimensions depending on the requirements of the particular application. The vertical support column 18 may be made from any of a wide range of materials, again depending on the requirements of the particular application. By way of example, in one preferred embodiment, each elongate support column 18 is fabricated from mild steel, although other materials may also be used.

Figure 5:
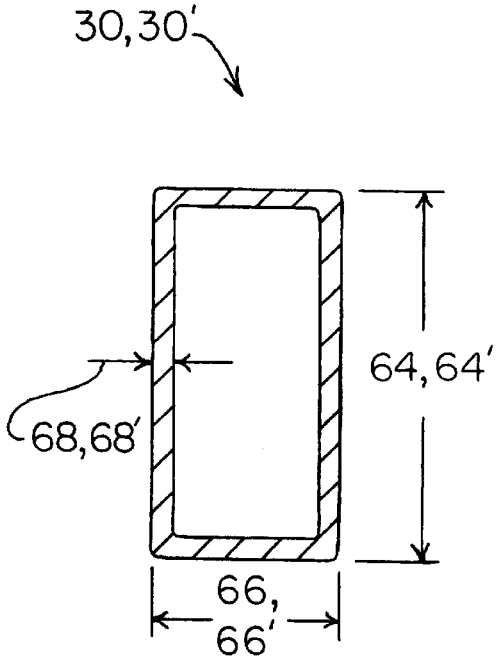
FIG. 5 is a cross-section view in elevation of a horizontal cross beam.

The horizontal cross beams 30 used to connect the upper portions 22 of the vertical support columns 18 may also comprise an elongate member, but having a generally rectangular cross section, as best seen in FIG. 5. In one preferred embodiment, each beam 30 may have a height 64 of about 3 inches and a width 66 of about 2 inches. The beam 30 may have a wall thickness 68 of about ⅛ inch. In one preferred embodiment, each horizontal cross beam 30 is made from mild steel. As was the case for the vertical support columns 18, the horizontal cross beam 30 may have other dimensions and/or be made from other materials, depending on the requirements particular application.

Each inner frame member 48 may be sized to fit within the particular mine entry for which the overcast is designed. By way of example, in one preferred embodiment, each inner frame member may have a width W (FIG. 1) of about 14'6" and a height H in the range of about 6'9" inches to about 8'9", with the height adjustment being provided by the retractable foot members 46, 46', as will be described in greater detail below. Alternatively, of course, each inner frame member 48 may be sized to other dimensions depending on the particular entry in which the ventilation overcast 10 is to be used.

The outer frame members 48' comprising the outer frame assembly 14 may be similar to the inner frame members 48 just described for the inner frame assembly 12. That is, in one preferred embodiment, the outer frame members 48' are essentially identical, with each outer frame member 48' comprising a pair of outer vertical support columns 18', each of which has a lower end 20' and an upper end 22', positioned in substantially opposed spaced-apart relation on opposite sides 24, 26 of the overcast 10. The respective upper ends 22' of the outer vertical support columns 18' are connected by an outer horizontal cross beam member 30', as best seen in FIG. 1.

Figure 3:
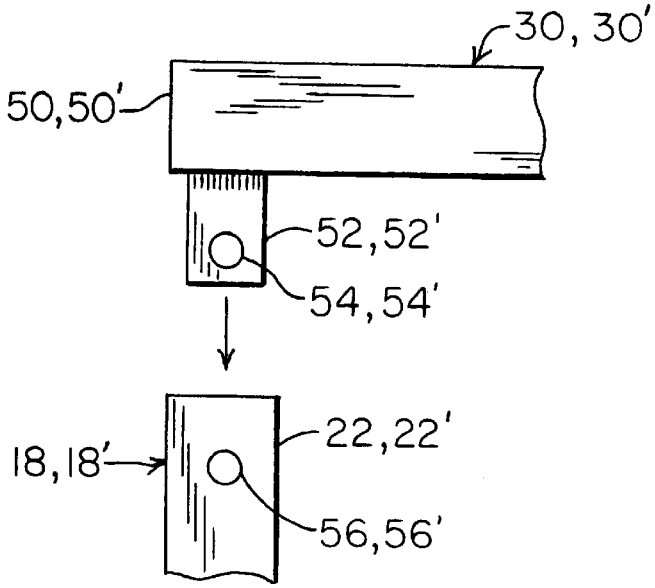
FIG. 3 is an enlarged elevation view showing one arrangement for attaching a horizontal cross beam to the upper end of a vertical support column.

As was the case for the inner frame members 48, the outer horizontal cross beam 30' of each outer frame member 48' may be joined to the upper ends 22' of the vertical support column 18' according to any of a wide variety of structural arrangements and fasteners that are well-known in the art. For example, in the embodiment shown and described herein, each end (e.g., 50') of the horizontal cross beam 30' may be provided with a connecting lug 52' designed to be received by the open upper end 22' of the outer vertical support column 18', as best seen in FIG. 3. The connecting lug 52' may be provided with a hole 54' therein positioned so that it aligns with a mating hole 56' provided in the upper end 22' of the outer vertical support column 18'. A pin or bolt and nut assembly (not shown) may be inserted through the aligning holes 54' and 56' to secure the outer horizontal cross beam 30' to the upper end 22' of the outer vertical support column 18'. Alternatively, other types of arrangements now known or that may be developed in the future may be utilized to secure the outer horizontal cross beam 30' to the outer vertical support column 18'.

As was the case for the inner frame members 48, adjacent outer vertical support columns 18' forming the various outer frame members 48' may be connected together by one or more stringers 88', as best seen in FIG. 2. The stringers 88' provide increased structural support to the overcast, particularly where the top and side panels 34 and 36 are not separately fastened to the outer frame members 48'. In one preferred embodiment, the stringers are affixed to the various vertical support columns 18' by means of welding. Alternatively, other types of fastening systems or devices may be used.

Each outer vertical support column 18' may be essentially identical to the inner vertical support columns 18 described above. That is, each outer vertical support column 18' may comprise an elongate member having a rectangular or square cross-section with a height 58' of about 2 inches, a width 60' of about 2 inches, and a wall thickness 62' of about ⅛ inch. See FIG. 4. Alternatively, the support column 18' may have other dimensions depending on the requirements of the particular application. The outer vertical support columns 18' may be made from any of a wide range of materials depending on the requirements of the particular application. By way of example, in one preferred embodiment, each outer support column 18' comprises mild steel, although other materials may also be used.

Referring now to FIG. 5, the outer horizontal cross beams 30' used to connect the upper portions 22' of the outer vertical support columns 18' may also comprise an elongate member having a generally rectangular cross section. In one preferred embodiment, each beam 30' may have a height 64' of about 3 inches and a width 66' of about 2 inches. The beam 30' may have a wall thickness 68' of about ⅛ inch. In one preferred embodiment, each horizontal cross beam 30' may be fabricated from mild steel, although other materials may also be used. As was the case for the other support members, the outer horizontal cross beam 30' may have other dimensions and/or be made from other materials, depending on the requirements of the particular application.

Figure 6:
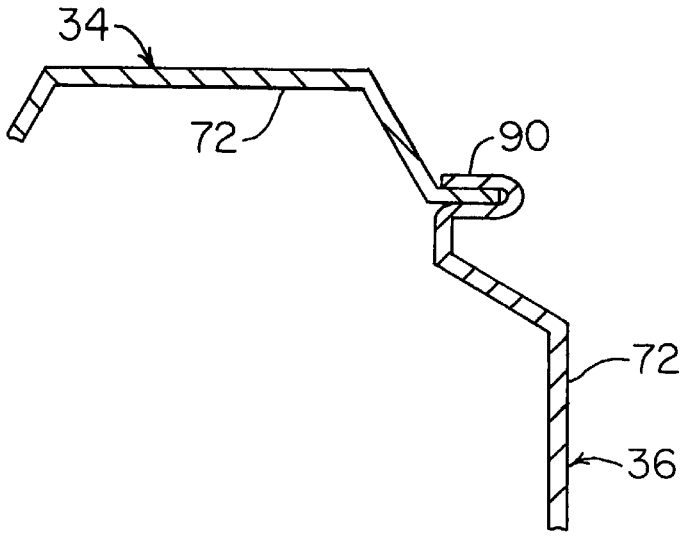
FIG. 6 is a cross-section view in elevation of the crimp used to join a top panel to a side panel.

With reference now to FIGS. 1, 2, and 6, the top panel 34 and side panels 36 may comprise ribbed panels having a plurality of upright "hat" shaped portions 70 separated from one another by inverted "hat" sections 72. See FIG. 1. It is preferred, but not required, that the side panels 36 be joined to the top panel 34 by means of the interlocking joint 90 shown in FIG. 6. So joining together the side panels 36 to the top panel 34 assures a substantially air-tight seal between the panels and also improves the structural integrity of the ventilation overcast 10.

The top panel 34 and side panels 36 may be made from any of a wide range of materials suitable for the intended application. By way of example, in one preferred embodiment, the top panel 34 and side panels 36 comprise panels formed from 20 gauge sheet steel. Of course, heavier or lighter gauges could also be used, again depending on the requirements of the particular application. The ribs (e.g., 70, 72) may be formed in the panels by any of a wide variety of processes (e.g., rolling) that are well-known in the art for forming sheet metal.

Depending on the overall width W (FIG. 1) of the overcast 10 (i.e, the distance between opposed side wall portions 24 and 26) or on other factors, it may be necessary or desirable to utilize two or more separate top panels 34 to form the roof portion 32 of the overcast 10. If so, the top panels 34 may be joined together by an interlocking joint similar to the interlocking joint 90 illustrated in FIG. 6 to provide a substantially air-tight seal between adjacent panels. Alternatively, the two or more top panels 34 may be overlapped or simply butted together, again depending on the requirements of the particular application.

A similar situation exists with respect to the side panels 36 that close the opposed sides 24, 26 of the overcast 10. That is, it may be necessary or desirable in certain applications to utilize two or more separate side panels 36 for each opposed side 24, 26. If so, the adjacent side panels may be joined together by means of the interlocking joint described above for the top panels 34.

The curtain members 38 located near the lower ends 20, 20' of the inner and outer vertical support columns 18, 18' are best seen in FIGS. 1 and 2 and may comprise generally elongate panels having a plurality of longitudinal corrugations 40 therein extending in the lengthwise direction 28, as best seen in FIG. 2. In one preferred embodiment, the longitudinal corrugations 40 provided in the curtain member 38 include at least one ridge portion 74 and at least one furrow portion 76 each of which comprises a smooth curve, as best seen in FIG. 7.

The curtain members 38 may be made from any of a wide range of materials suitable for the intended application. By way of example, in one preferred embodiment, each curtain member 38 is fabricated from 20 gauge steel. Alternatively, steel having either heavier or lighter gauges may also be used, again depending on the requirements of the particular application. The longitudinal corrugations 40 provided therein may be formed by any of a wide variety of processes, e.g., rolling, that are well-known in the art for forming sheet metal panels.

Figure 7:
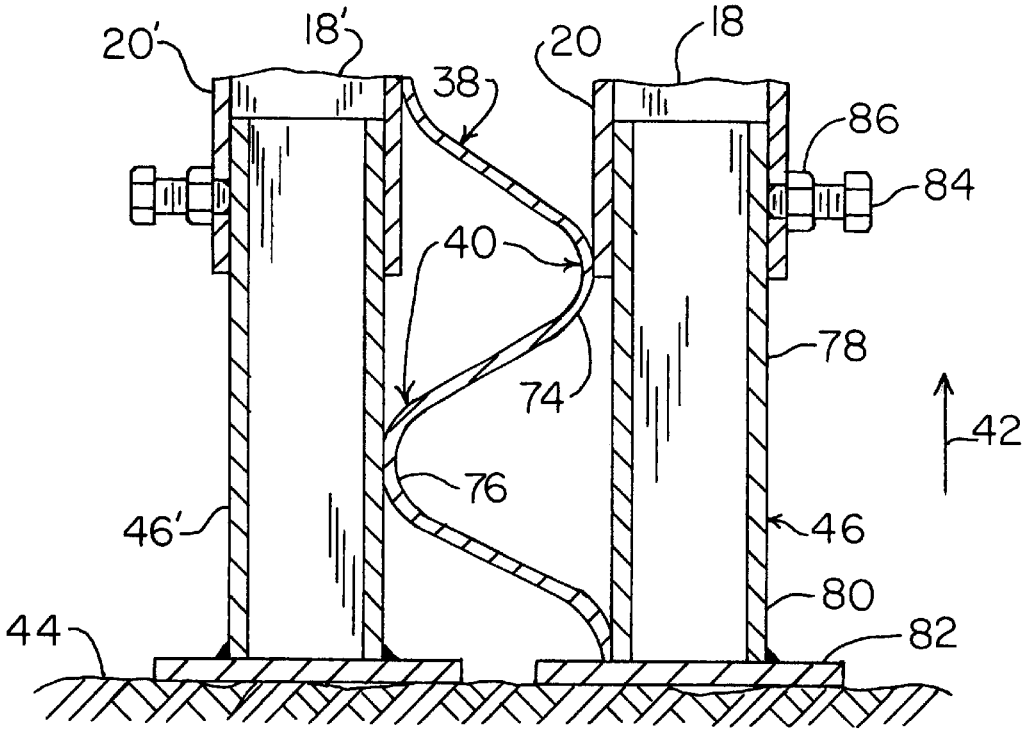
FIG. 7 is an enlarged elevation view of the lower ends of the inner and outer vertical support columns showing the arrangement of the retractable foot members and the corrugated curtain member.

With reference now primarily to FIG. 7, the lower ends 20, 20' of the inner and outer vertical support columns 18 and 18' may be provided with retractable foot members 46, 46' which may yield or move in the direction indicated by arrow 42 if the floor 44 heaves excessively. Each retractable foot member 46, 46' may be essentially identical to the others and may comprise an elongate leg section 78 sized to be slidably received by the open lower end 20 of the corresponding vertical support column 18 or 18' as the case may be. The lower end 80 of leg section 78 may be provided with a plate 82 which may be affixed thereto by any convenient fastening system or device (e.g., by welding). The retractable foot member 46 may be frictionally engaged with the lower end 20 of the vertical support column 18 by means of a bolt 84 threaded into a nut 86 secured to the lower end 20 of support column 18. When tightened, the bolt 84 securely holds the foot member 46 to the support column 18, but will allow the foot member 46 to yield (i.e., move further into the support column 18, as indicated by arrow 42) when subjected to excessive pressure, such as may be caused by the heaving of the floor 44 of the mine. As each retractable foot member 46 yields, the adjacent curtain member 38 will also yield (i.e., by means of crushing or collapsing along the corrugations 40), thereby preventing structural damage to the other portions of the ventilation overcast 10.

The leg section 78 of each retractable foot member 46 may be provided with a length sufficient to allow the desired degree of travel (e.g., extension and retraction of the foot member 46). By way of example, in one preferred embodiment, the leg section 78 is provided with a length sufficient to allow the foot member 46 to be extended by about 2 feet. Alternatively, other lengths may also be used.

The ventilation overcast 10 may be installed as follows. As a first step in the installation process, the various outer vertical support columns 18' may be positioned on opposite sides of the mine entry (not shown), preferably with their respective foot members 46' fully retracted into the outer vertical support columns 18'. Next, the inner support columns 18 may be placed adjacent the outer vertical support columns 18', again, preferably with their respective foot members 46 fully retracted. Thereafter, the inner horizontal cross beams 30 may be attached to the upper ends 22 of the various inner vertical support columns 18. Once all of the inner horizontal cross beams 30 have been secured in position, the user may slide the top panels 34 over the tops of the inner horizontal cross beams 30 so that the same are supported thereby. At this time, the various side panels 36 also may be moved into position between the inner and outer vertical support columns 18, 18'. Finally, the curtain members 38 may be positioned between the lower ends 20, 20' of the inner and outer vertical support columns 18, 18' and the inner and outer foot members 46, 46'.

After the panels 34, 36 and curtains 38 have been properly positioned adjacent the inner frame assembly 12, the outer horizontal cross beams 30' may be secured between the outer vertical support columns 18' to complete the outer frame assembly 14. A hoist or jack arrangement then may be used to raise the roof portion 32 of the ventilation overcast 10 to the appropriate height. Thereafter, the inner and outer foot members 46 and 46' may be lowered so that they contact the mine floor 44. The restraining bolts 84 may be tightened to a torque sufficient to provide the desired yield characteristic, i.e., to allow the foot 46 to yield when subjected to a desired force. The curtain members 38 may then be attached to the respective side panel members 36. Alternatively, the curtain members 38 may by positioned adjacent the side panel members 36 so that the two members 36 and 38 are free to slide past one another, as best seen in FIG. 1. In any event, any subsequent floor heave will be accommodated by the corrugated curtain members 38 and retracting foot members 46, 46', thereby allowing a substantially air-tight seal to be maintained between the mine floor 44 and the overcast 10. The arrangement also prevents the ventilation overcast 10 from being otherwise damaged due to floor heave.

It is contemplated that the inventive concepts herein described may be variously otherwise embodied and it is intended that the appended claims be construed to include alternative embodiments of the invention except insofar as limited by the prior art.

What is claimed is:

1. A ventilation overcast, comprising:

a frame member defining a structure having a substantially inverted U-shape with first and second opposed side wall portions and a roof portion;

a curtain member positioned adjacent each of said wall portions said frame member so that a bottom portion of said curtain member contacts a floor of a mine, said curtain member having a plurality of longitudinal corrugations therein, said longitudinal corrugations allowing said curtain member to be crushed when subjected to floor heave.

2. The ventilation overcast of claim 1, wherein said frame member comprises:

a plurality of support columns, each of which has an upper end and a lower end;

a plurality of cross beams connected between the upper ends of each of said plurality of support columns.

3. The ventilation overcast of claim 2, wherein said corrugations in said curtain member comprise at least one ridge portion and at least one furrow portion.

4. The ventilation overcast of claim 3, wherein said ridge portion and said furrow portion comprise smooth curves.

5. The ventilation overcast of claim 4, wherein said curtain member comprises steel.

* * * * *

UNITED STATES PATENT AND TRADEMARK OFFICE

CERTIFICATE OF CORRECTION

PATENT NO. : 6,334,738 B1
DATED : January 1, 2002
INVENTOR(S) : Rudolph J. Juracko It is certified that error appears in the above-identified patent and that said Letters Patent is hereby corrected as shown below:

Column 2,
Line 11, after "the floor of the mine." insert -- The longitudinal corrugations allow the curtain member to be crushed when subjected to floor heave. --

Signed and Sealed this

Thirteenth Day of August, 2002

*Attest:*

*Attesting Officer*

JAMES E. ROGAN
*Director of the United States Patent and Trademark Office*